United States Patent [19]

Hatayama et al.

[11] 4,132,921

[45] Jan. 2, 1979

[54] MEGNETRONS GETTER

[75] Inventors: Shunichi Hatayama; Masao Sakai, both of Mobara, Japan

[73] Assignee: Hitachi, Ltd., Tokyo, Japan

[21] Appl. No.: 795,775

[22] Filed: May 11, 1977

[30] Foreign Application Priority Data

May 14, 1976 [JP] Japan ..... 51-54392

[51] Int. Cl.[2] ..... H01J 25/50

[52] U.S. Cl. ..... 315/39.51; 313/174; 313/175; 315/39.53

[58] Field of Search ..... 315/39.51, 39.53; 313/174, 175, 176, 178

[56] References Cited

U.S. PATENT DOCUMENTS

| | | | |
|---|---|---|---|
| 2,417,789 | 3/1947 | Spencer | 313/174 X |
| 2,496,887 | 2/1950 | Nelson | 313/174 X |
| 3,078,387 | 2/1963 | Dorgelo | 313/174 X |
| 3,275,866 | 9/1966 | Zwobada et al. | 313/178 X |
| 3,988,636 | 10/1976 | Sato et al. | 315/39.51 |

*Primary Examiner*—Saxfield Chatmon, Jr.
*Attorney, Agent, or Firm*—Charles E. Pfund

[57] ABSTRACT

A magnetron comprises a cathode electrode, a cylindrical anode electrode provided with a plurality of vanes aranged in the radial direction with respect to the cathode electrode to surround the same, and a pair of frust-conical magnetic pole pieces disposed on both ends of the anode electrode for guiding magnetic flux from an external permanent magnet to the interior of the anode electrode. Non-evaporation type sintered metal powder getters are secured on the surface of the magnetic pole pieces facing the interior of the anode electrode except the tip surface of the frust-conical magnetic pole pieces.

5 Claims, 5 Drawing Figures

MEGNETRONS GETTER

BACKGROUND OF THE INVENTION

This invention relates to a magnetron, especially to getters for absorbing residual gas prevailing inside the magnetron.

Generally, as a magnetron generates efficiently microwaves, it may especially be incorporated in a microwave oven, and widely used for defreezing or heating foods. Accordingly, improvement of its life, safeness and quality has eagerly been requested.

FIG. 1 is a fragmentary, sectional view showing one example of conventional magnetron generally used. In this figure, numeral 1 designates a cylindrical anode made of oxygen free copper, for example, and 1*a* a plurality of vanes secured, in equally spaced angular relationship, to the inner wall of the anode cylinder in radial direction with respect to a cathode filament 2.

The anode cylinder 1 and vanes 1a constitute an anode structure. The cathode filament is made of a helical thorium-tungsten wire having a carbonized surface, for example. The helical cathode is arranged concentric with the axis of the anode cylinder 1 so that a so-called interaction space is formed between the cathode filament and the vanes 1*a*. Flange-shaped upper and lower end shields 3 and 4 each made of such a high melting metal as molybdenum or tungsten are secured to both end portions of the cathode filament 2 by welding, for example, and disc shaped getters 5 and 6 made of such a metal as zirconium are secured by welding to opposing surfaces of the flanges of upper and lower end shields 3 and 4. The upper end shield 3 is supported by central support 7 and the lower end shield 4 by side supports 8. The central support 7 and side support 8 also act as electrical lead wires and supply electric current to the cathode filament 2 from an external power supply (not shown). The frust-conical magnetic pole pieces 9 and 10 made of iron, for example, which are secured to both ends of the anode cylinder 1 direct the magnetic flux from an external permanent magnet 12 as shown at two dot chain line in FIG. 1 into the interaction space. When a current is supplied to the cathode filament 2 through the central support 7 and side support 8, thermionic electrons given off by the cathode filament 2 are discharged into the interaction space to induce an oscillation. With this construction of the conventional magnetron, however, the disc shaped getters 5 and 6 made of zirconium, for example, are secured by welding to respective opposing surfaces of the upper and lower end shields 3 and 4, that is, the surfaces of getters 5 and 6 are arranged to face the interaction space. Therefore, if the dimension and surface area of the getters 5 and 6 are increased or the purpose of greatly promoting the absorption effect for the residual gas in the magnetron, the output high frequency electromagnetic field would be disturbed so that it is difficult to provide large size getters for the conventional magnetron. Furthermore, since the upper and lower end shields are discs each having an outer diameter of about 8 mm and the central support 7 having a diameter of about 5 mm extends through the center of the end shields, the effective area roomed for the getters 5 and 6 is relatively small. Further, the end shield for supporting the getter is made of high melting point metal. For these reasons, securing and welding of getters are difficult and mounting of getters on the end shields is usually carried out by spot welding. However, since the cathode filament 2 made of a thorium-tungsten carbide having a small mechanical strength is secured to the opposing surfaces of the upper and lower end shields 3 and 4, it is difficult to weld the filament without damaging the cathode filament. Furthermore, the welded getters undergo thermal deformation due to the heat generated at the time of operation, and sometimes a spark strikes across a small gap (of about 0.6 mm) between the free end portions of vanes 1a and the getters thereby causing insulation breakdown. Although getters 5 and 6 may possibly be mounted at other portions than the interaction space which tends to be adversely affected by the mounting of the getters, most of the portions inside the magnetron participate in propagation in high frequency energies and thus, locations suitable for supporting the getters are limited to avoid undesirable disturbance of the electromagnetic field and degradation of the output characteristics. Furthermore, as the material of anode comprises copper which has low weldability, great task remains for selecting positions suitable for supporting the getter at which getter activation temperature is optimum and undesirable output characteristics are not caused.

SUMMARY OF THE INVENTION

An object of this invention is to provide an improved magnetron in which getters can readily be mounted on a relatively large area and can effectively absorb residual gas.

Another object of this invention is to provide a highly reliable magnetron in which insulation breakdown will not occur.

These object of this invention can be accomplished by providing a magnetron of the type comprising a cathode electrode, a cylindrical anode electrode provided with a plurality of vanes arranged in the radial directions with respect to cathode electrode to surround the same, the cathode electrode and the vanes defining an interaction space therebetween, and a pair of magnetic pole pieces including frustconical magnetic pole pieces disposed on the opposite ends of anode electrode for guiding the magnetic flux from an external permanent magnet to the interaction space, characterized in that non-evaporation type sintered metal powder getters are secured to the surface of the magnetic pole pieces facing the interior of the anode electrode except the tip surface of the frust-conical magnetic pole pieces.

BRIEF DESCRIPTION OF THE DRAWINGS

Further objects and features of this invention will be more fully understood from the following description taken in conjunction with the accompanying drawings, in which.

DESCRIPTION OF PREFERRED EMBODIMENTS

Figure 1:
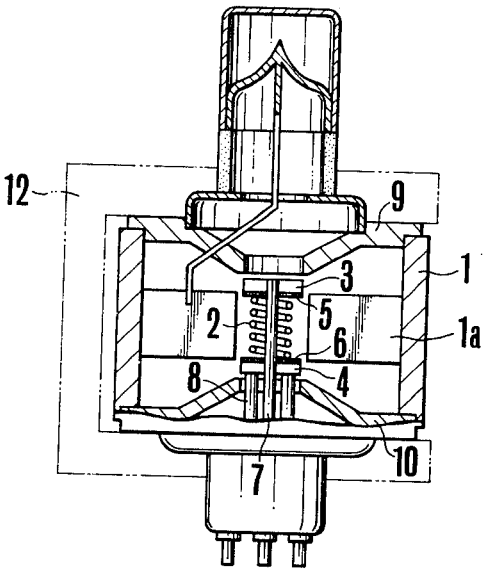
FIG.1 (PRIOR ART)
FIG. 1 is a fragmentary, sectional view showing one example of conventional magnetron.
Figure 2:
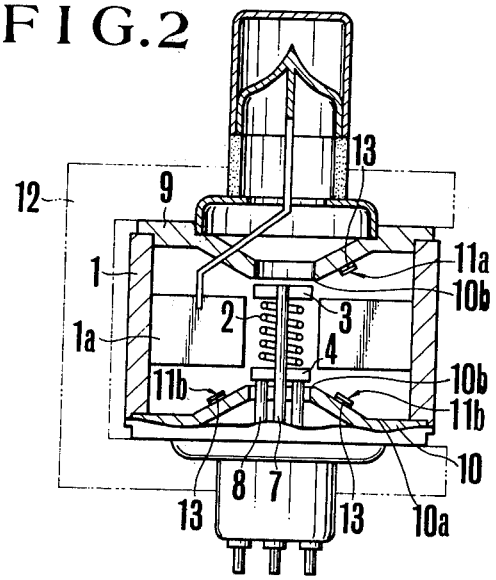
FIG. 2 is a similar view to FIG. 1 showing one embodiment according to this invention.

FIG. 2 is a fragmentary, sectional view showing one embodiment of magnetron according to this invention, in which the same numerals as those in FIG. 1 correspond to like parts, of which further explanation will be omitted. According to this invention, bulk or non-evaporation type sintered metal powder getters 11a and **11*b* of suitable size are formed on the surfaces of the inclined portions of the frust-conical magnetic pole pieces 9 and 10 which in turn are secured to the opposite ends of the anode cylinder 1 and face the inner wall of the anode cylinder 1. As the getters 11*a* and 11*b*, it is advantageous to use Zr-Al alloy, Zr, Ti, Ta and the like a powder of which is coated on an iron substrate 13 having a thickness of about 0.1 mm to a thickness of 0.1 mm to 0.2 mm and then sintered. The iron substrate is advantageous for its welding to the magnetic pole piece since the magnetic pole pieces are made of iron. Alternatively, instead of using iron substrate 13**, the Zr-Al alloy powder may be coated on the magnetic pole piece surface and then sintered. When a zirconuim plate is used as getter, the plate may be welded directly to the surface of the magnetic pole piece.

Although getters **11*a* and 11*b* may possibly be mounted on flat skirt portions 10*a* of the frust-conical magnetic pole pieces, the inclined surface of the magnetic pole piece is suitable to mount the getters for the following reason. In general, a getter needs an activation temperature for its activation. For example, an activation temperature of Zr-Al alloy ranges from 400° C. to 1000° C. On the other hand, considering the temperature distribution in the magnetron during operation, the temperature near the cathode filament 2 is about 1700° C., that at the tip and near the inclined surface of the inner surface of the magnetic pole piece 10 is 400° C. to 500° C., that at the mounting portions of the vanes 1*a* to the anode cylinder is 150° C. to 200° C. and that near the skirt 10a of magnetic pole piece is about 200° C. This temperature distribution shows that the inclined surface of the magnetic pole piece is suitable to mount the getter. It may also be possible to mount the getter on the bottom surface of the frust-conical magnetic pole piece, that is, on surface 10*b* facing the upper and lower end shields. In this case, however, the distance between the getter and the upper and lower end shields 3 and 4 is not always definite due to assembling error as well as the dimensional erros of various component members, so that spark may strike between the getter and the upper and lower end shields 3 and 4 or between the getter and the side supports, thus greatly degrading insulating characteristic. For the reasons described above, it is impossible to arrange the getters at that portion. Accordingly, in accordance with this invention, the getters 11*a* and 11*b* are mounted on the portions except the tip 10*b* of the frust-conical magnetic pole piece 10, especially on the inclined surfaces of the magnetic pole pieces 9 and 10**.

Figure 3A:
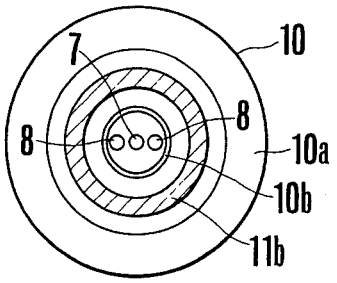
FIGS. 3*a* through 3*c* are views showing various examples of mounting getters to magnetic pile piece according to this invention.
Figure 3B:
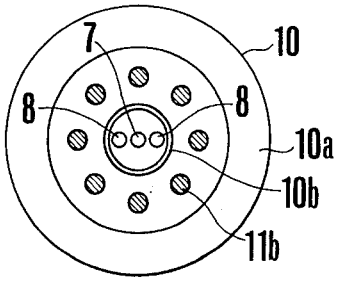
Figure 3C:
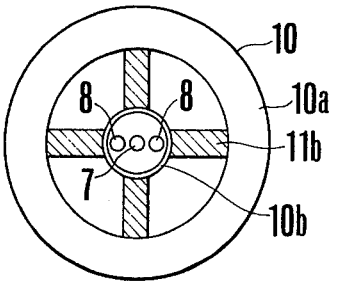

FIGS. **3*a* to 3*c* illustrate various examples of mounting the getter according to this invention by way of the lower magnetic pole piece 10 as viewed from the underside of the lower end shield 4. By providing getter 11*b* as shown by shaded portion, a getter arrangement having a suitable area can be obtained. The example shown in FIG. 3*a* in which the getter is formed as an annulus surrounding the inclined surface is suitable to obtain a getter having a relatively large area. Although FIG. 2 shows the getters as being amounted to both the upper and lower magnetic pole pieces 9 and 10**, a single bulk getter may be provided for either one of both the magnetic pole pieces. Obviously, the larger the number of getters, the more is promoted the effect of the absorption of residual gas.

As described above, in the magnetron of this invention, bulk getters **11*a* and 11*b* having a suitable size are mounted on the inclined surfaces of the magnetic pole pieces 9 and 10 made of such ferromagnetic metal as iron. Since the inclined surfaces of the magnetic pole pieces are heated by the heat generated during the operation to a temperature suitable for activating the getters, and since the temperature of the inclined surfaces is not increased exceeding that of the upper and lower end shields 3 and 4, it is possible to greatly increase the life of getters 11*a* and 11*b* and to prevent thermal deformation thereof. Accordingly, there is no fear that the getter peels off and abuts the anode structure to cause spark, whereby the quality of the magnetron can be improved greatly. Moreover, as magnetic pole pieces 9 and 10, to which getters 11*a* and 11*b* are welded, are made of iron and not closely adjacent to the cathode filament 2 which has an extremely small mechanical strength, welding operation can be made considerably easy, thus greatly improving workability. In addition, prior to the assemblage of magnetron, the welding of the bulk getter to magnetic pole piece 9 or 10** can readily be automated, thereby reducing the manufacturing cost.

What is claimed is:

1. In a magnetron of the type comprising a cathode electrode, a cylindrical anode electrode provided with a plurality of vanes arranged in the radial direction with respect to said cathode electrode to surround the same, said cathode electrode and said vanes defining an interaction space therebetween, and a pair of magnetic pole pieces including frust-conical magnetic pole pieces disposed on the opposite ends of said anode electrode for guiding the magnetic flux from an external permanent magnet to the interaction space, the improvement which comprises a non-evaporation type sintered metal powder getter secured to the surface of said magnetic pole piece facing the interior of said anode electrode except the tip of the frust-conical magnetic pole piece.

2. The magnetron according to claim 1, wherein said getter is mounted on the conical inclined surface of said magnetic pole piece facing the interior of said anode electrode.

3. The magnetron according to claim 2, wherein said getter takes the form of annulus circling said conical inclined surface.

4. The magnetron according to claim 1, wherein said getter comprises a powdery getter substance coated on the magnetic pole piece and then sintered.

5. The magnetron according to claim 1, wherein said getter comprises a substrate to be welded to the magnetic pole piece and a powdery getter substance coated on the substrate and sintered thereon.

* * * * *